US010635015B1

(12) United States Patent
Senoo et al.

(10) Patent No.: US 10,635,015 B1
(45) Date of Patent: Apr. 28, 2020

(54) OPTICAL WRITING DEVICE AND IMAGE FORMING DEVICE

(71) Applicant: KONICA MINOLTA, INC., Chiyoda-ku, Tokyo (JP)

(72) Inventors: Wataru Senoo, Okazaki (JP); Hidenari Tachibe, Toyokawa (JP); Takafumi Yuasa, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/559,678

(22) Filed: Sep. 4, 2019

(30) Foreign Application Priority Data

Oct. 11, 2018 (JP) ..... 2018-192585

(51) Int. Cl.
*G03G 15/041* (2006.01)

(52) U.S. Cl.
CPC ..... *G03G 15/0415* (2013.01)

(58) Field of Classification Search
CPC ..... G03G 15/0415
See application file for complete search history.

(56) References Cited

U.S. PATENT DOCUMENTS 6,411,325 B1 * 6/2002 Matsushita ..... B41J 2/473 347/134
2008/0050151 A1 * 2/2008 Kato ..... G03G 15/04036 399/221
2009/0003881 A1 * 1/2009 Tahk ..... G02B 7/008 399/218
2012/0062685 A1 * 3/2012 Serizawa ..... B41J 2/471 347/224
2015/0261120 A1 * 9/2015 Fujii ..... G03G 15/0435 347/133
2016/0375699 A1 * 12/2016 Yamamura ..... B41J 2/45 347/258
2018/0101003 A1 * 4/2018 Ogura ..... G02B 7/181

FOREIGN PATENT DOCUMENTS

JP 2011197081 A 10/2011

OTHER PUBLICATIONS

Extended European Search Report issued in corresponding European Patent Application No. 19201128, dated Feb. 11, 2020 (9 pages).

* cited by examiner

*Primary Examiner* — G. M. A Hyder
(74) *Attorney, Agent, or Firm* — Buchanan Ingersoll & Rooney PC

(57) ABSTRACT

An optical writing device includes a light source, a deflector, an imager, and a casing, wherein the imager includes a scanning optical member, the casing includes an optical axis direction positioner, the optical axis direction positioner includes two one side positioners, and one other side positioner, a central position in a sub-scanning direction of the one other side positioner is located between central positions in the sub-scanning direction of the two one side positioners, the scanning optical member is bonded to the casing at a bonding position, and a position in the sub-scanning direction of the bonding position and a position in the sub-scanning direction of the optical axis direction positioner overlap with each other, a main-scanning direction positioner is further provided, and the main-scanning direction positioner is located on the other side with respect to the central position of the scanning optical member in the main-scanning direction.

11 Claims, 16 Drawing Sheets

FIG. 8A
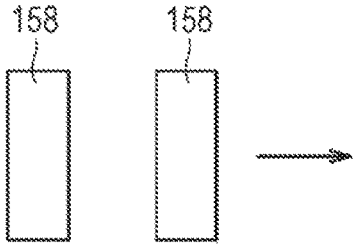
FIG. 8B
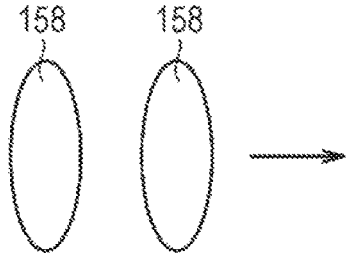
FIG. 8C
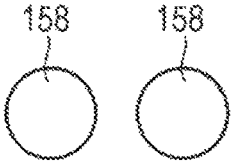
FIG. 9A
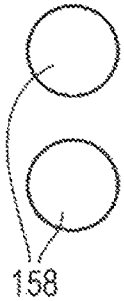
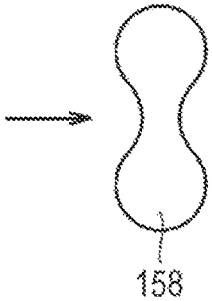
FIG. 9B
FIG. 9C
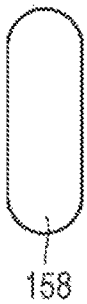
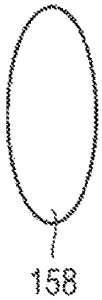
FIG. 9D
FIG. 9E
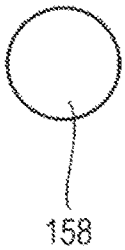

OPTICAL WRITING DEVICE AND IMAGE FORMING DEVICE

The entire disclosure of Japanese patent Application No. 2018-192585, filed on Oct. 11, 2018, is incorporated herein by reference in its entirety.

BACKGROUND

Technological Field

The present invention relates to an optical writing device and an image forming device. More specifically, the present invention relates to an optical writing device and an image forming device capable of suppressing deterioration in optical performance.

Description of the Related Art

An electrophotographic image forming device includes a multi function peripheral (M P) having a scanner function, a facsimile function, a copying function, a function as a printer, a data communication function, and a server function, a facsimile device, a copier, a printer and the like.

Some electrophotographic image forming devices form an electrostatic latent image by scanning light beam on an image carrier from an optical writing device. This image forming device develops the electrostatic latent image using a developer to form a toner image, transfers the toner image to paper, and then fixes the toner image on the paper by a fixer, thereby forming an image on the paper.

In an image forming device which performs color printing, the optical writing device is provided with a light source which outputs laser light for each of colors of yellow (Y), magenta (M), cyan (C), and black (K), a deflector (polygon mirror) which deflects the light emitted from the light source to scan, an imager which images the light deflected by the deflector on a surface to be scanned, and a casing which holds the imager. The imager includes a scanning optical member having a power in a main-scanning direction. The optical writing device forms an electrostatic latent image on an image carrier for the respective colors of Y, M, C, and K by performing an exposure process of irradiating the image carrier for the respective colors of Y, M, C, and K with laser light.

FIG. 15 is a cross-sectional view schematically illustrating a configuration of a bonding portion between a scanning optical member 150 and a casing 160 in a conventional optical writing device. Note that, in the drawings, an x axis direction is an optical axis direction. A y axis direction is a main-scanning direction. The y axis direction is an extending direction of the scanning optical member in which the scanning optical member has the power. A z axis direction is a sub-scanning direction. The x axis, y axis, and z axis are orthogonal to one another.

With reference to FIG. 15, the casing 160 is in contact with the scanning optical member 150 with two positioners 162*a* and 162*b* protruding in the optical axis direction (x axis direction), and the scanning optical member 150 is positioned in the x axis direction by the positioners 162*a* and 162*b*. The positioner 162*a* is provided on one side (left side in FIG. 15) with respect to a central position CL in the main-scanning direction (y axis direction) of the scanning optical member 150. The positioner 162*b* is provided on the other side (right side in FIG. 15) with respect to the central position CL in the main-scanning direction (y axis direction) of the scanning optical member 150. The scanning optical member 150 is also bonded to the casing 160 with an adhesive 158. The scanning optical member 150 is bonded to the casing 160 at bonding positions (adhesives) 151*a*, 151*b*, 151*c*, and 151*d*. The bonding positions 151*a* and 151*b* are provided in proximity to the positioner 162*a* and interpose the positioner 162*a* in the main-scanning direction. The bonding positions 151*c* and 151*d* are provided in proximity to the positioner 162*b* and interpose the positioner 162*b* in the main-scanning direction. Positional displacement of the scanning optical member 150 in the optical axis direction adversely affects optical performance of the scanning optical member 150. Therefore, by providing the positioners 162*a* and 162*b*, the position in the optical axis direction of the scanning optical member 150 is fixed.

FIG. 16 is a view schematically illustrating a tensile force generated due to thermal expansion of the scanning optical member 150 and the casing 160 in the conventional optical writing device.

With reference to FIG. 16, when temperature around the scanning optical member 150 becomes high, each of the scanning optical member 150 and the casing 160 expands as indicated by arrow F1 (a length of arrow F1 indicates a thermal expansion amount). At that time, due to a difference in linear expansion coefficient between the scanning optical member 150 and the casing 160, a difference in the thermal expansion amount occurs between the scanning optical member 150 and the casing 160, and the tensile force is applied to the adhesive 158. In order to suppress peeling of the adhesive 158 and deformation of the scanning optical member 150 due to this tensile force, the difference in the thermal expansion amount is relaxed by the adhesive by bonding the scanning optical member 150 and the casing 160 by thick-film bonding The configuration of the conventional optical writing device is disclosed, for example, in JP 2011-197081 A. JP 2011-197081 A discloses a technology of bonding a long lens to a lens holder at two points. In this technology, three seating surfaces for positioning in the sub-scanning direction are provided. The three seating surfaces are provided at both ends and at the center.

FIGS. 17A and 17B are partially enlarged views illustrating a configuration in the vicinity of the positioner 162 in the conventional optical writing device. Note that the positioner 162 corresponds to positioners 162*a* or 162*b* in FIG. 15.

With reference to FIGS. 17A and 17B, in order to make the optical writing device compact, the positioner 162 in the optical axis direction and the adhesive 158 are arranged in proximity to each other in general. When the positioner 162 and the adhesive 158 are arranged in proximity to each other, the adhesive 158 before curing moves in the main-scanning direction due to variation in position of the adhesive 158 at the time of application, deformation of the adhesive 158 before curing and the like, and is brought into contact with (reaches) the positioner 162 as illustrated in FIG. 17A sometimes. In a case where the adhesive 158 is brought into contact with the positioner 162, the adhesive present in a contact portion becomes a thin film.

When the optical writing device operates, temperature around the scanning optical member 150 becomes high due to rotation of the polygon motor, light emission of a light emitting element, or heat transfer from the surroundings. When the temperature around the scanning optical member 150 becomes high, a difference in the thermal expansion amount occurs between the scanning optical member 150 and the casing 160. A thin film portion of the adhesive 158 enters between the scanning optical member 150 and the positioner 162 as illustrated in FIG. 17B by the tensile force (mainly a shear force in the main-scanning direction) applied to the adhesive 158 due to the difference in the thermal expansion amount. As a result, there is a problem that the position in the optical axis direction of the scanning optical member 150 changes, and the optical performance of the optical writing device is deteriorated.

SUMMARY

The present invention is intended to solve the above-described problems, and an object thereof is to provide an optical writing device and an image forming device capable of suppressing the deterioration in optical performance.

To achieve the abovementioned object, according to an aspect of the present invention, an optical writing device reflecting one aspect of the present invention comprises a light source, a deflector that deflects light emitted from the light source to scan, an imager that images the light deflected by the deflector on a surface to be scanned, and a casing that holds the imager, wherein the imager includes a scanning optical member having a power in a main-scanning direction, the scanning optical member having a linear expansion coefficient different from a linear expansion coefficient of the casing, the casing includes an optical axis direction positioner that protrudes in an optical axis direction of the scanning optical member and is in contact with the scanning optical member in the optical axis direction, the optical axis direction positioner includes two one side positioners located on one side with respect to a central position of the scanning optical member in the main-scanning direction, and one other side positioner located on the other side with respect to the central position of the scanning optical member in the main-scanning direction, a central position in a sub-scanning direction of the one other side positioner is located between central positions in the sub-scanning direction of the two one side positioners, the scanning optical member is bonded to the casing at a bonding position, and a position in the sub-scanning direction of the bonding position and a position in the sub-scanning direction of the optical axis direction positioner overlap with each other, a main-scanning direction positioner that defines a position in the main-scanning direction of the scanning optical member with respect to the casing is further provided, and the main-scanning direction positioner is located on the other side with respect to the central position of the scanning optical member in the main-scanning direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 8A to 8C are views schematically illustrating an example of a change with time of a planar shape of an adhesive before curing;

FIGS. 9A to 9E are views schematically illustrating another example of the change with time of the planar shape of the adhesive before curing;

DETAILED DESCRIPTION OF EMBODIMENTS

Hereinafter, one or more embodiments of the present invention will be described with reference to the drawings. However, the scope of the invention is not limited to the disclosed embodiments.

In the following embodiment, a case where an image forming device is an MFP is described. The image forming device may be a printer, a facsimile device, a copier or the like in addition to the MFP.

First, a configuration of the image forming device in this embodiment is described.

Figure 1:
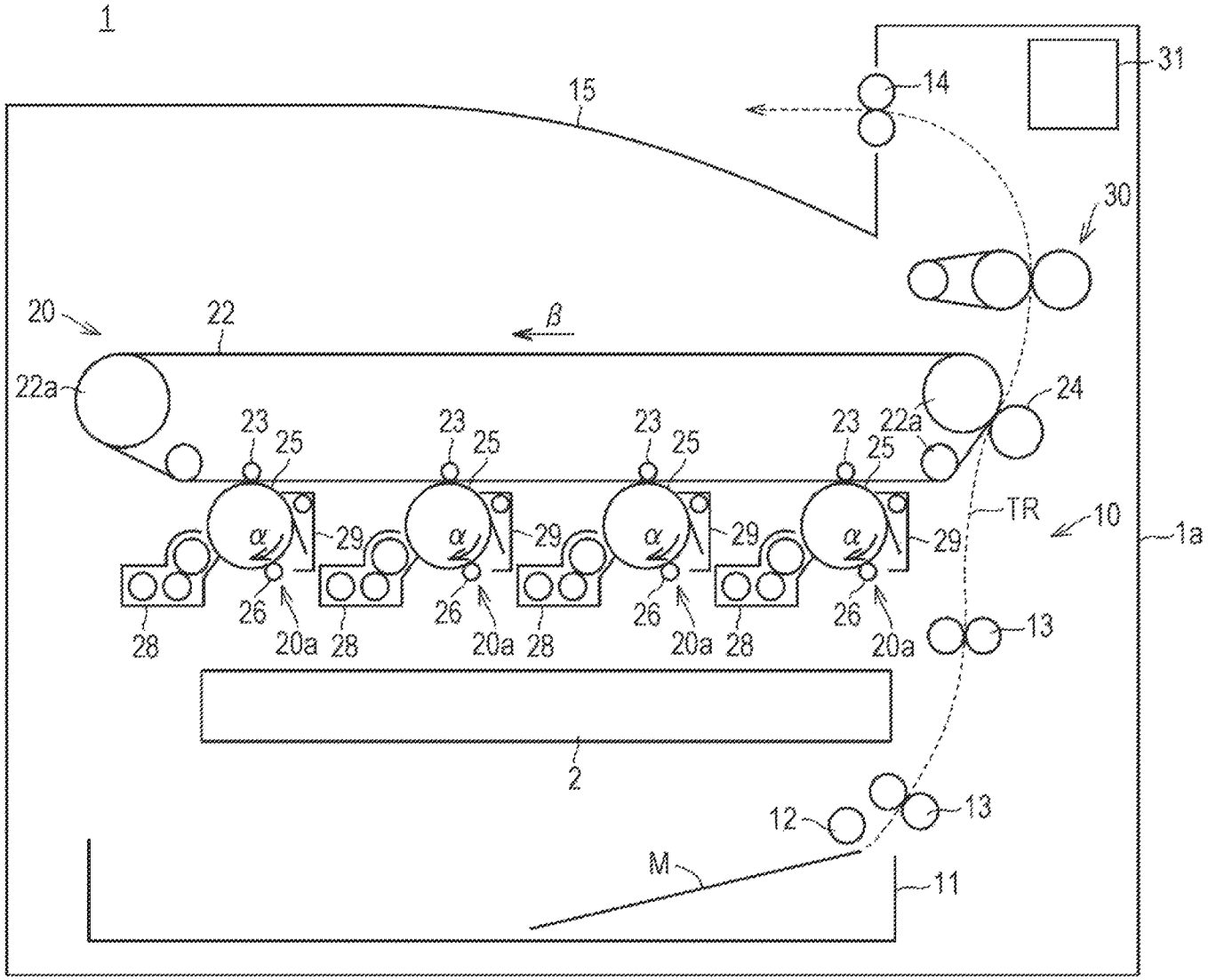
FIG. 1 is a cross-sectional view schematically illustrating a configuration of an image forming device in an embodiment of the present invention.

FIG. 1 is a cross-sectional view schematically illustrating a configuration of an image forming device 1 in an embodiment of the present invention.

With reference to FIG. 1, the image forming device 1 (an example of an image forming device) in this embodiment is mainly provided with an optical writing device 2 (an example of an optical writing device), a paper conveyance unit 10, a toner image forming unit 20 (an example of an image former), a fixing device 30 (an example of a fixer), and a control unit 31.

The paper conveyance unit 10 conveys paper M one by one along a conveyance path TR. The paper conveyance unit 10 includes a paper feed tray 11, a paper feed roller 12, a plurality of conveyance rollers 13, a paper discharge roller 14, and a paper discharge tray 15. The paper feed tray 11 accommodates the paper M on which an image is to be formed. There may be a plurality of paper feed trays 11. The paper feed roller 12 is provided between the paper feed tray 11 and the conveyance path TR. Each of the plurality of conveyance rollers 13 is provided along the conveyance path TR. The paper discharge roller 14 is provided on a most downstream part of the conveyance path TR. The paper discharge tray 15 is provided on an uppermost part of an image forming device main body 1*a*.

The toner image forming unit 20 forms toner images of four colors of Y, M, C, and K obtained by developing an electrostatic latent image formed by the optical writing device 2 on the conveyed paper M. The toner image forming unit 20 includes image forming units 20*a* for respective colors of Y, M, C, and K, an intermediate transfer belt 22, primary transfer rollers 23 for the respective colors of Y, M, C, and K, and a secondary transfer roller 24.

The image forming units 20*a* for the respective colors of Y, M, C, and K are arranged in a horizontal direction in this order, and the optical writing device 2 is arranged below the image forming units 20*a* for the respective colors of Y, M, C, and K. The image forming unit 20*a* for each of the colors of Y, M, C, and K includes a photosensitive drum 25, a charging roller 26, a developing device 28, a cleaning device 29 and the like. The photosensitive drum 25 is rotary driven in a direction indicated by arrow α in FIG. 1. The charging roller 26, the developing device 28, and the cleaning device 29 are provided around the photosensitive drum 25.

The intermediate transfer belt 22 is provided above the image forming units 20*a* of the respective colors of Y, M, C, and K. The intermediate transfer belt 22 is annular and is wound around rotating rollers 22*a*. The intermediate transfer belt 22 is rotary driven in a direction indicated by arrow β in FIG. 1. Each of the primary transfer rollers 23 opposes to each of the photosensitive drums 25 with the intermediate transfer belt 22 interposed therebetween. The secondary transfer roller 24 is in contact with the intermediate transfer belt 22 on the conveyance path TR.

The fixing device 30 fixes the toner images formed by the toner image forming unit 20 on the paper M by conveying the paper carrying the toner image along the conveyance path TR while gripping the same.

A control unit 31 is formed of a central processing unit (CPU) which controls an entire image forming device 1 in accordance with a control program, a read only memory (ROM) which stores the control program, a random access memory (RAM) which forms a work area of the CPU and the like.

The image forming device 1 rotates the photosensitive drum 25 to charge a surface of the photosensitive drum 25 by the charging roller 26. The image forming device 1 exposes the charged surface of the photosensitive drum 25 according to image forming information by the optical writing device 2, and forms an electrostatic latent image on the surface of the photosensitive drum 25.

Next, the image forming device 1 supplies toner from the developing device 28 to the photosensitive drum 25 on which the electrostatic latent image is formed to perform development, and forms the toner image on the surface of the photosensitive drum 25.

Next, the image forming device 1 sequentially transfers the toner image formed on the photosensitive drum 25 to a surface of the intermediate transfer belt 22 using the primary transfer roller 23 (primary transfer). In a case of a full-color image, on the surface of the intermediate transfer belt 22, the toner image obtained by synthesizing the toner images of the respective colors of Y, M, C, and K is formed.

The image forming device 1 removes toner remaining on the photosensitive drum 25 without being transferred to the intermediate transfer belt 22 by the cleaning device 29.

Subsequently, the image forming device 1 conveys the toner image formed on the surface of the intermediate transfer belt 22 to a position opposed to the secondary transfer roller 24 by the rotating roller 22*a*.

On the other hand, the image forming device 1 supplies the paper M accommodated in the paper feed tray 11 by the paper feed roller 12 and guides the same to a portion between the intermediate transfer belt 22 and the secondary transfer roller 24 along the conveyance path TR by each of the plurality of conveyance rollers 13. Then, the image forming device 1 transfers the toner image formed on the surface of the intermediate transfer belt 22 to the paper M by the secondary transfer roller 24.

The image forming device 1 guides the paper M to which the toner image is transferred to the fixing device 30 and fixes the toner image on the paper M by the fixing device 30. Thereafter, the image forming device 1 discharges the paper M on which the toner image is fixed to the paper discharge tray 15 by the paper discharge roller 14.

Next, a configuration of the optical writing device 2 in this embodiment is described.

Figure 2:
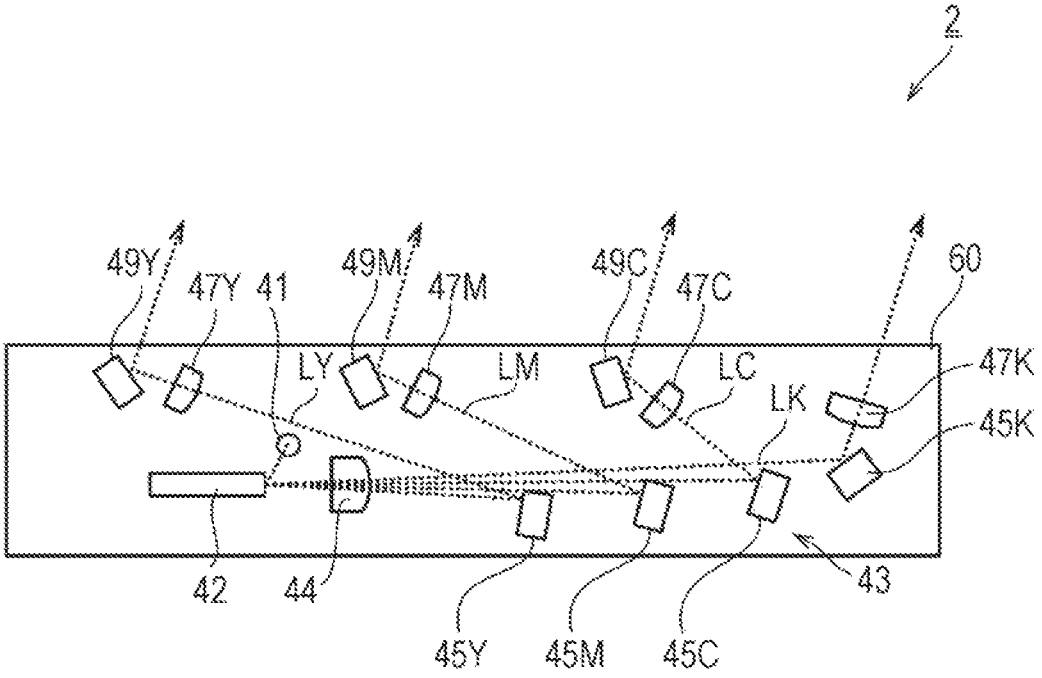
FIG. 2 is a side view illustrating a configuration of an optical writing device in an embodiment of the present invention.

FIG. 2 is a side view illustrating the configuration of the optical writing device 2 in an embodiment of the present invention.

With reference to FIG. 2, the optical writing device 2 is provided with a light source 41 (an example of a light source), a deflector 42 (an example of a deflector), an imaging unit 43 (an example of an imager), and a casing 60 (an example of a casing). The casing 60 accommodates the light source 41, the deflector 42, and the imaging unit 43, and holds the light source 41, the deflector 42, and the imaging unit 43.

The light source 41 is, for example, a semiconductor laser device, and emits laser light for each of the colors of Y, M, C, and K. The laser light emitted from the light source 41 passes through a collimator lens, a cylindrical lens (not illustrated) or the like to be incident on a mirror surface of the deflector 42.

The deflector 42 formed by a polygon mirror deflects the light emitted from the light source 41 to scan. The deflector 42 rotates the polygon mirror including a plurality of reflecting surfaces on a side surface thereof by a motor and deflects the laser light incident on the reflecting surface to scan.

The imaging unit 43 images each of the four lights deflected by the deflector 42 on the surface of each of the four photosensitive drums 25. The imaging unit 43 includes a lens 44, reflection mirrors 45Y, 45M, 45C, and 45Y, lenses 47Y, 47M, 47C, and 47K, and auxiliary reflection mirrors 49Y, 49M, and 49C. Each of the lenses 47Y, 47M, 47C, and 47K has a power in a main-scanning direction.

The reflection mirror 45Y, the lens 47Y, and the auxiliary reflection mirror 49Y are optical elements for yellow (Y). The reflection mirror 45Y reflects laser light LY for yellow deflected by the deflector 42 and passes through the lens 44.

The lens 47Y and the auxiliary reflection mirror 49Y transmit the laser light LY reflected by the reflection mirror 45Y and reflect the laser light LY toward the surface of the photosensitive drum 25 for yellow.

The reflection mirror 45M, the lens 47M, and the auxiliary reflection mirror 49M are optical elements for magenta (M). The reflection mirror 45M reflects laser light LM for magenta deflected by the deflector 42 and passes through the lens 44. The lens 47M and the auxiliary reflection mirror 49M transmit the laser light LM reflected by the reflection mirror 45M and reflect the laser light LM toward the surface of the photosensitive drum 25 for magenta.

The reflection mirror 45C, the lens 47C, and the auxiliary reflection mirror 49C are optical elements for cyan (C). The reflection mirror 45C reflects laser light LC for cyan deflected by the deflector 42 and passes through the lens 44. The lens 47C and the auxiliary reflection mirror 49C transmit the laser light LC reflected by the reflection mirror 45C and reflect the laser light LC toward the surface of the photosensitive drum 25 for cyan.

The reflection mirror 45K and the lens 47K are optical elements for black (K). The reflection mirror 45K reflects a laser light LK for black deflected by the deflector 42 and passes through the lens 44. The lens 47K transmits the laser light LK reflected by the reflection mirror 45K and applies the same to the surface of the photosensitive drum 25 for black.

Hereinafter, any one of the lenses 47Y, 47M, 47C, and 47K is sometimes referred to as a scanning optical member 50 (an example of a scanning optical member). The scanning optical member 50 is only required to have the power in the main-scanning direction, and this may be a lens holding member provided with a lens in place of the lens. The scanning optical member 50 may also be a curved surface reflecting member, or may also have a power in a sub-scanning direction.

Subsequently, a configuration of the scanning optical member 50 is described.

Figure 3:
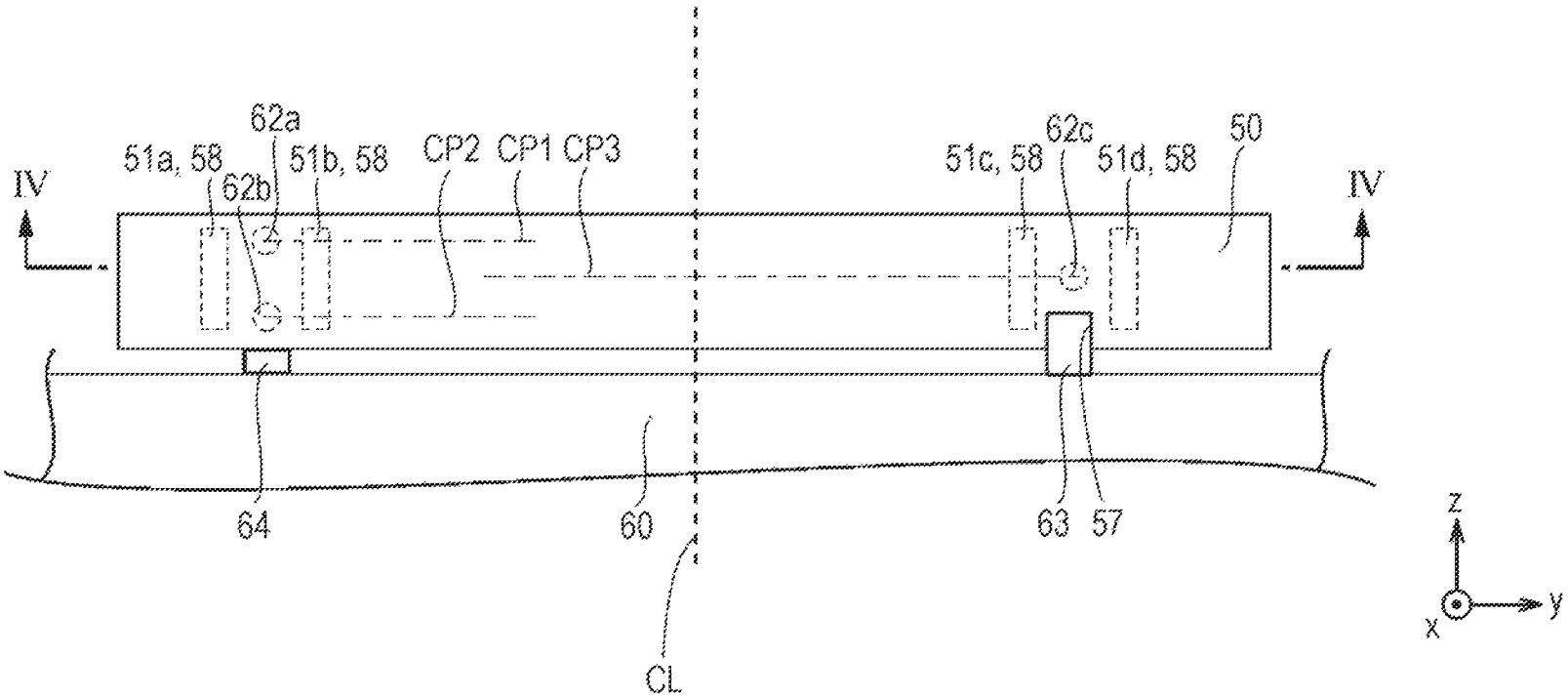
FIG. 3 is a view illustrating a configuration of a scanning optical member in an embodiment of the present invention as seen from a positive side of an x axis.
Figure 4:
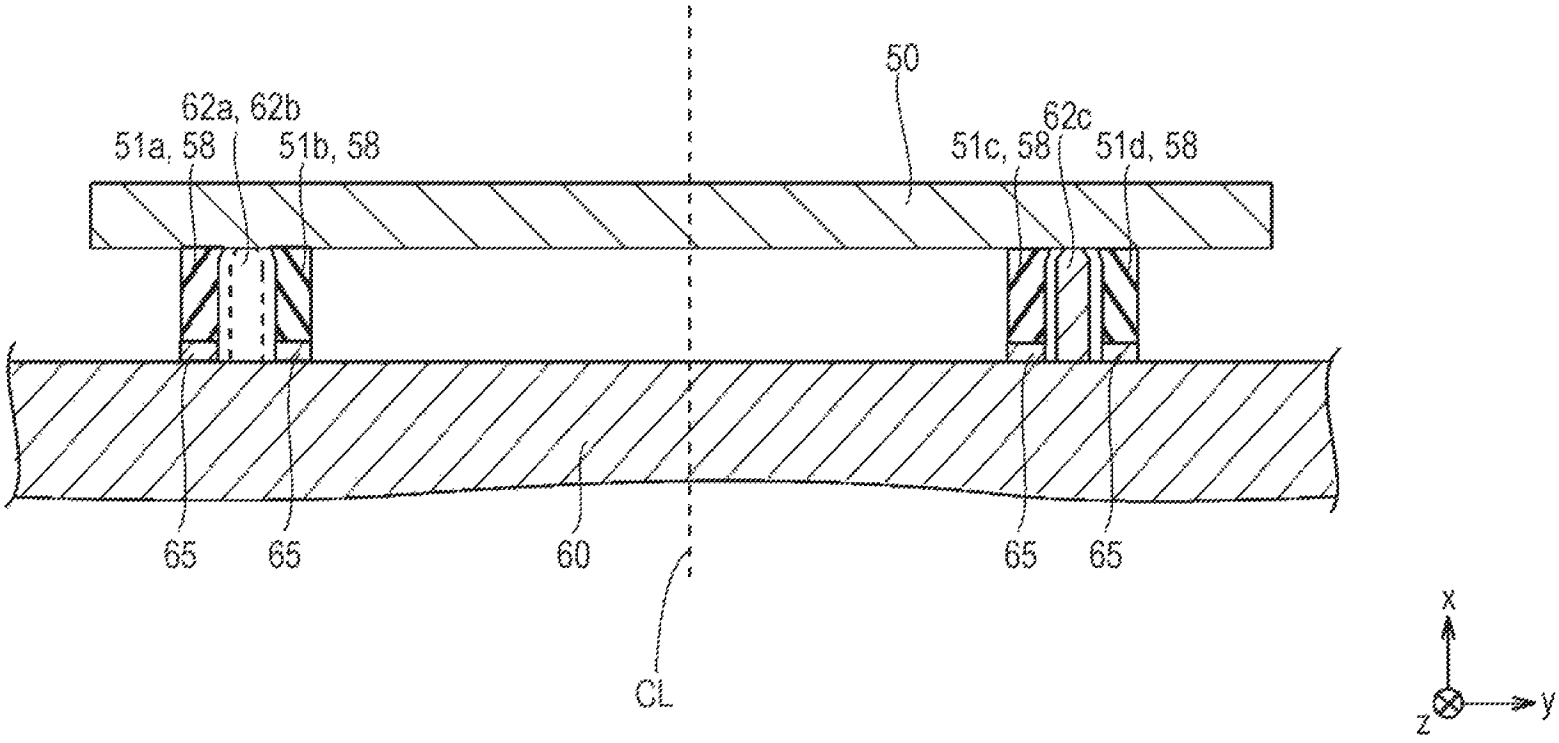
FIG. 4 is a cross-sectional view schematically illustrating a configuration of a bonding portion between the scanning optical member and a casing in the optical writing device according to an embodiment of the present invention (a cross-sectional view taken along line Iv-Iv in FIG. 3)

FIG. 3 is a view illustrating the configuration of the scanning optical member 50 in an embodiment of the present invention as seen from a positive side of an x axis. FIG. 4 is a cross-sectional view schematically illustrating a configuration of a bonding portion between the scanning optical member 50 and the casing 60 in the optical writing device 2 according to an embodiment of the present invention (a cross-sectional view taken along line Iv-Iv in FIG. 3). Note that, in FIG. 3, positioners 62*a*, 62*b*, and 62*c* and an adhesive 58 do not actually appear, but are indicated by dotted lines for the convenience of description. In FIG. 4, the positioners 62*a* and 62*b* do not actually appear, but are indicated by dotted lines for the convenience of description.

With reference to FIGS. 3 and 4, the scanning optical member 50 and the casing 60 are thick-film bonded using the adhesive 58. The thick-film bonding means bonding with an adhesive having a thickness (length in an optical axis direction) of 0.5 mm or more. The adhesive 58 has a characteristic of contracting upon curing. By thick-film bonding the scanning optical member 50 and the casing 60 with the adhesive 58, it is possible to easily fix a position in the optical axis direction of the scanning optical member 50 without providing a biasing member for biasing the scanning optical member 50 in the optical axis direction. Also, by providing the biasing member, the position in the optical axis direction of the scanning optical member 50 may be firmly fixed.

The adhesive 58 may be a thermosetting type or a photocuring type. Especially, by using an ultraviolet curing adhesive having a low Young's modulus as the adhesive 58, a large shearing force does not occur even when it is deformed at the time of thermal expansion, and it is possible to suppress peeling of the adhesive 58 and deformation of the scanning optical member 50.

The scanning optical member 50 has the power in the main-scanning direction and is elongated in the main-scanning direction. The scanning optical member 50 is bonded to the casing 60 by the adhesive 58 in the optical axis direction. The adhesive 58 has a characteristic of being cured by ultraviolet light or heat. The scanning optical member 50 is bonded to the casing 60 at four bonding positions 51*a*, 51*b*, 51*c*, and 51*d* (examples of bonding positions). Each of the bonding positions 51*a*, 51*b*, 51*c*, and 51*d* has an arbitrary planar shape, for example, a rectangular planar shape. In order to secure bonding strength while limiting a space in the main-scanning direction, each of the bonding positions 51*a*, 51*b*, 51*c*, and 51*d* preferably has a shape longer in the sub-scanning direction than in the main-scanning direction. The scanning optical member 50 is made of, for example, a resin. The scanning optical member 50 has a linear expansion coefficient different from a linear expansion coefficient of the casing 60.

Note that, a central position of the scanning optical member in the main-scanning direction is sometimes referred to as a central position CL.

The casing 60 has an L shape as seen in a cross-section taken along an xz plane and supports the scanning optical member 50 from a negative side of the x axis and a negative side of a z axis. The casing 60 includes positioners 62*a*, 62*b*, and 62*c* (examples of an optical axis direction positioner), a positioner 63 (an example of a main-scanning direction positioner), a positioner 64, and a pedestal portion 65. The casing 60 is made of a material different from that of the scanning optical member 50 (for example, a resin different from that of the scanning optical member 50).

The positioners 62*a*, 62*b*, and 62*c* are used for defining the position in the optical axis direction of the scanning optical member 50. The positioners 62*a*, 62*b*, and 62*c* protrude in the optical axis direction (the positive direction of the x axis) and are in contact with a plane on the negative side of the x axis of the scanning optical member 50 in the optical axis direction. The positioners 62*a* and 62*b* are located on a negative side of a y axis with respect to the central position CL. The bonding positions 51*a* and 51*b* interpose the positioners 62*a* and 62*b* in the main-scanning direction on the negative side of the y axis with respect to the central position CL. The positioner 62*c* is located on a positive side of the y axis with respect to the central position CL. The bonding positions 51*c* and 51*d* interpose the positioner 62*c* in the main-scanning direction on the positive side of the y axis with respect to the central position CL.

In a case where central positions in the sub-scanning direction of the positioners 62*a*, 62*b*, and 62*c* are central positions CP1, CP2, and CP3, respectively, the central position CP3 in the sub-scanning direction of the positioner 62*c* is located between the central position CP1 in the sub-scanning direction of the positioner 62*a* and the central position CP2 in the sub-scanning direction of the positioner 62*b*. As a result, it becomes possible to stably hold the scanning optical member 50.

Herein, there is a following reason that the number of the positioners which define the position in the optical axis direction is three of the scanning optical member 50. In a case where there are two positioners which define the position in the optical axis direction of the scanning optical member 50, there is a risk that the position of the scanning optical member 50 is not stable because a contact position between the scanning optical member 50 and the positioner is too small. In a case where there are four positioners which define the position in the optical axis direction of the scanning optical member 50, there is a risk that the position of the scanning optical member 50 is not stable because of displacement in length in the x axis direction of each of the four positioners. Therefore, it becomes possible to stably hold the scanning optical member 50 because there are three positioners which define the position in the optical axis direction of the scanning optical member 50.

The positioner 63 is used for defining the position in the main-scanning direction of the scanning optical member 50 with respect to the casing 60. The positioner 63 is located on the positive side of they axis with respect to the central position CL of the scanning optical member 50 in the main-scanning direction. The positioner 63 includes a convex formed on the casing 60, the convex which engages with a concave 57 provided on the scanning optical member 50.

The positioner 64 is used for defining the position in the sub-scanning direction of the scanning optical member 50. The positioner 64 protrudes in the sub-scanning direction (the positive direction of the z axis) and is in contact with a plane on the negative side of the z axis of the scanning optical member 50 in the sub-scanning direction. The positioner 64 is located on the negative side of the y axis with respect to the central position CL.

There are four pedestal portions 65 provided on a surface of the casing 60 corresponding to the bonding positions 51*a*, 51*b*, 51*c*, and 51*d*. Each of the pedestal portions 65 slightly protrudes in the z axis direction, and the adhesive 58 is applied to each of the pedestal portions 65.

Figure 5:
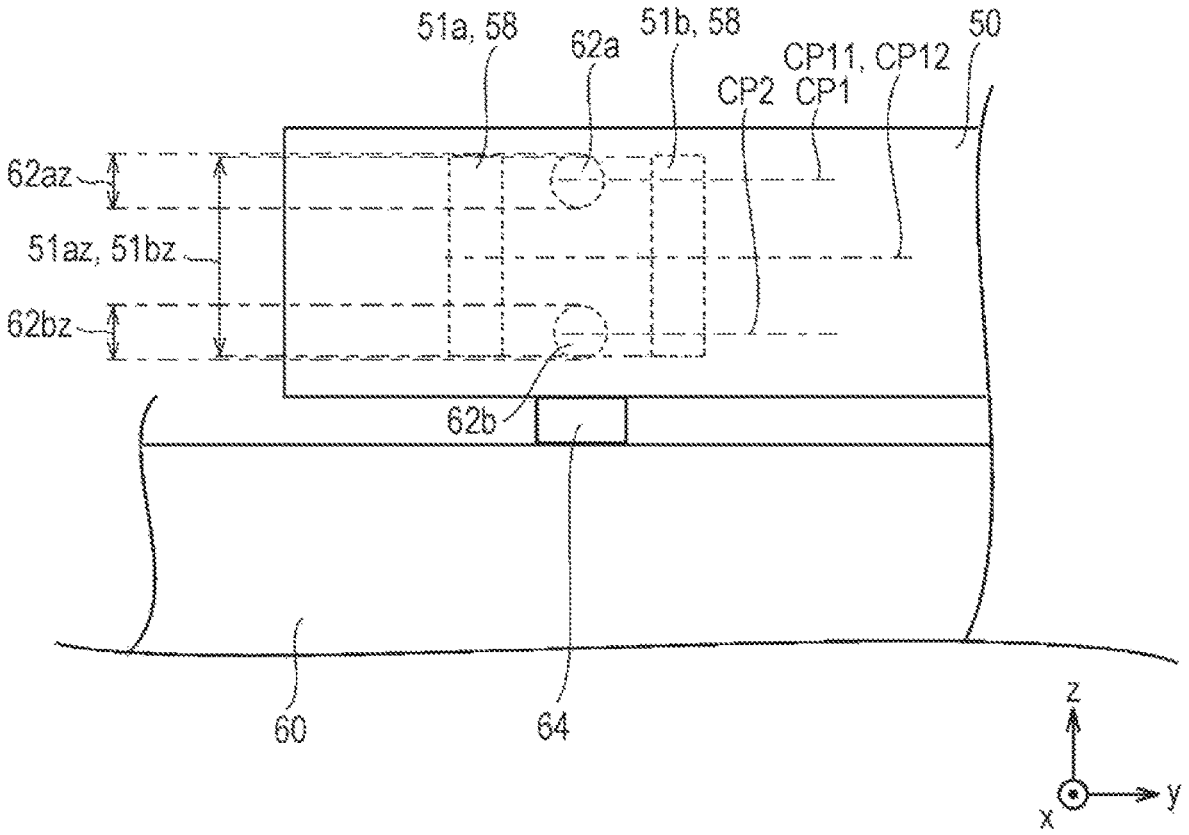
FIG. 5 is a view illustrating a layout in the vicinity of positioners in the scanning optical member according to an embodiment of the present invention.
Figure 6:
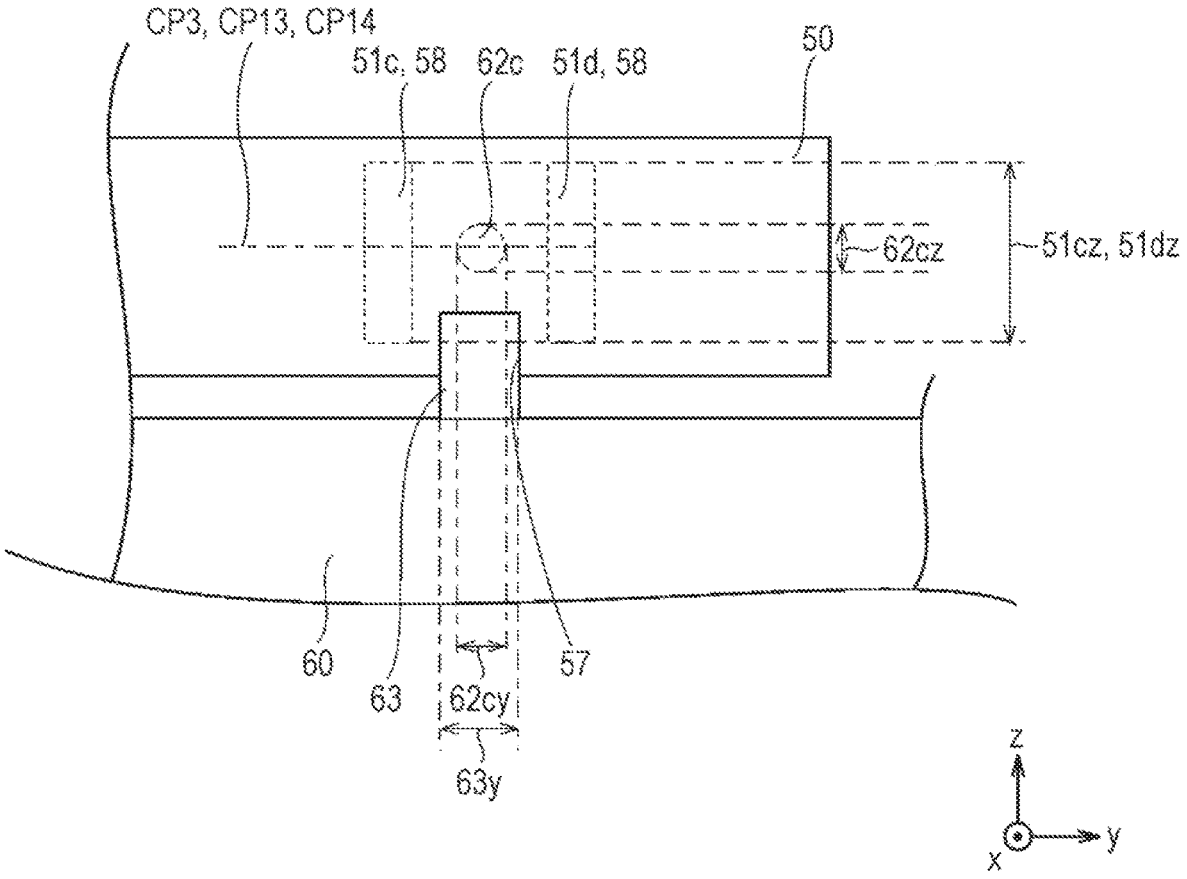
FIG. 6 is a view illustrating a layout in the vicinity of a positioner in the scanning optical member according to an embodiment of the present invention.

FIG. 5 is a view illustrating a layout in the vicinity of the positioners 62*a* and 62*b* in the scanning optical member 50 according to an embodiment of the present invention. FIG. 6 is a view illustrating a layout in the vicinity of the positioner 62*c* in the scanning optical member 50 according to an embodiment of the present invention.

With reference to FIG. 5, each of a position 51*az* in the sub-scanning direction of the bonding position 51*a* and a position 51*bz* in the sub-scanning direction of the bonding position 51*b* overlaps with a position 62*az* in the sub-scanning direction of the positioner 62*a*. Each of the position 51*az* in the sub-scanning direction of the bonding position 51*a* and the position 51*bz* in the sub-scanning direction of the bonding position 51*b* overlaps with a position 62*bz* in the sub-scanning direction of the positioner 62*b*.

The central position CP1 in the sub-scanning direction of the positioner 62*a* is different from a central position CP11 in the sub-scanning direction of the bonding position 51*a* and a central position CP12 in the sub-scanning direction of the bonding position 51*b*. The central position CP2 in the sub-scanning direction of the positioner 62*b* is different from the central position CP11 in the sub-scanning direction of the bonding position 51*a* and the central position CP12 in the sub-scanning direction of the bonding position 51*b*.

Also, each of the central position CP1 in the sub-scanning direction of the positioner 62*a* and the central position CP2 in the sub-scanning direction of the positioner 62*b* overlaps with the position 51*az* in the sub-scanning direction of the bonding position 51*a* and the position 51*bz* in the sub-scanning direction of the bonding position 51*b*.

Note that, the position 51*az* in the sub-scanning direction of the bonding position 51*a* and the position 51*bz* in the sub-scanning direction of the bonding position 51*b* are herein the same; however, they may also be different from each other.

With reference to FIG. 6, each of a position 51*cz* in the sub-scanning direction of the bonding position 51*c* and a position 51*dz* in the sub-scanning direction of the bonding position 51*d* overlaps with a position 62*cz* in the sub-scanning direction of the positioner 62*c*.

Also, a position 63*y* in the main-scanning direction of the positioner 63 and a position 62*cy* in the main-scanning direction of the positioner 62*c* overlap with each other.

Furthermore, the central position CP3 in the sub-scanning direction of the positioner 62*c* is the same as a central position CP13 in the sub-scanning direction of the bonding position 51*c* and a central position CP14 in the sub-scanning direction of the bonding position 51*d*.

Note that, the position 51*cz* in the sub-scanning direction of the bonding position 51*c* and the position 51*dz* in the sub-scanning direction of the bonding position 51*d* are herein the same; however, they may also be different from each other.

Subsequently, an effect of this embodiment is described.

Figure 7:
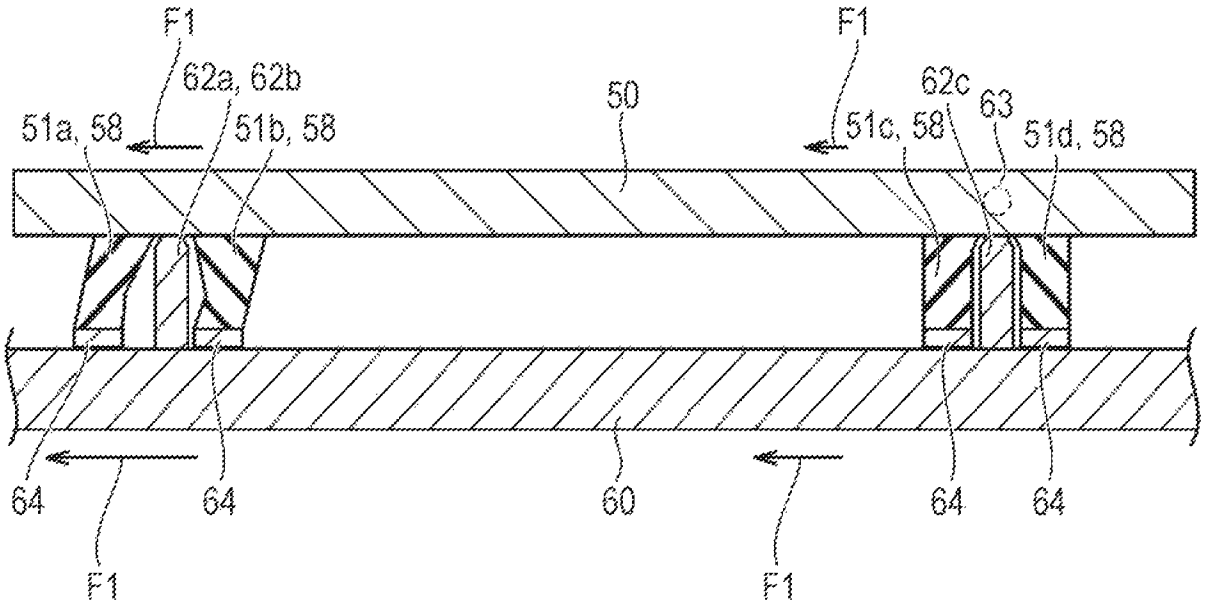
FIG. 7 is a view schematically illustrating a tensile force generated due to thermal expansion of the scanning optical member and the casing in the optical writing device according to an embodiment of the present invention.

FIG. 7 is a view schematically illustrating a tensile force generated due to thermal expansion of the scanning optical member 50 and the casing 60 in the optical writing device 2 according to an embodiment of the present invention. The positioner 63 does not actually appear, but this is indicated by a dotted line for the convenience of description in FIG. 7.

With reference to FIG. 7, the scanning optical member 50 having the power in the main-scanning direction affects optical performance when the position in the main-scanning direction of which deviates from a design value. Therefore, by providing the positioner 63, the position in the main-scanning direction is defined.

When temperature around the scanning optical member 50 becomes high, each of the scanning optical member 50 and the casing 60 expands as indicated by arrow F1 (a length of arrow F1 indicates a thermal expansion amount). At that time, due to a difference in linear expansion coefficient between the scanning optical member 50 and the casing 60, a difference in the thermal expansion amount occurs between the scanning optical member 50 and the casing 60.

Figure 17A:
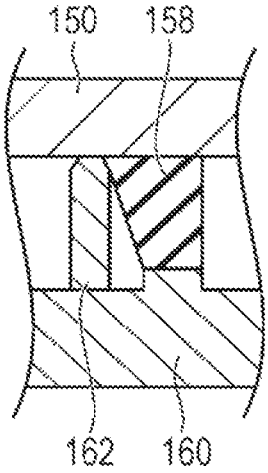
FIGS. 17A and 17B are partially enlarged views illustrating a configuration in the vicinity of a positioner in the conventional optical writing device.
Figure 17B:
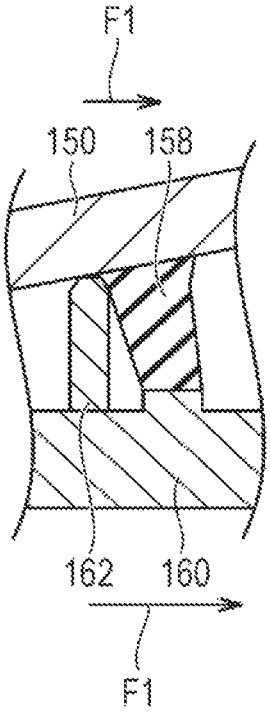

Herein, since the positioner 63 engages with the scanning optical member 50, the position of the positioner 63 becomes a starting point in the main-scanning direction of the thermal expansion of each of the scanning optical member 50 and the casing 60. In other words, the difference in the thermal expansion amount between the scanning optical member 50 and the casing 60 increases with a distance from the positioner 63 in the main-scanning direction. Even when the difference in the thermal expansion amount occurs between the scanning optical member 50 and the casing 60, the tensile force applied to the adhesive 58 at the bonding positions 51*c* and 51*d* located in the vicinity of the positioner 63 decreases. As a result, even when the adhesive 58 before curing is brought into contact with (reaches) the positioner 62*c* by a phenomenon described with reference to FIGS. 17A and 17B, a thin film portion of the adhesive 58 does not enter between the scanning optical member 50 and the positioner 62*c*. As a result, on the positive side of the y axis (side on which the positioner 62*c* is provided) with respect to the central position CL, it is possible to suppress a change in the position in the optical axis direction of the scanning optical member 50 and suppress deterioration in optical performance of the optical writing device 2. Especially, in a case where the position 63*y* in the main-scanning direction of the positioner 63 and the position 62*cy* in the main-scanning direction of the positioner 62*c* overlap with each other (FIG. 6), it is possible to make the tensile force applied to the adhesive 58 at the bonding positions 51*c* and 51*d* located in the vicinity of the positioner 63 substantially zero.

FIGS. 8A to 8C and 9A to 9E are views schematically illustrating a change with time of the planar shape of the adhesive 158 before curing.

With reference to FIGS. 8A to 8C, the adhesive has a characteristic to deform by an action of surface tension of the adhesive itself from when this is applied to the bonding position to when this is cured. Specifically, the adhesive 158 has a characteristic to deform into a planar shape close to a circle in the order from FIG. 8A, then FIG. 8B, and FIG. 8C. As a result, the adhesive tends to swell in a central position of the bonding position at the time of application.

With reference to FIGS. 9A to 9E, even in a case where the adhesive 158 is applied to two different bonding positions also, the adhesive 158 tends to be combined from two to one in the order from FIG. 9A, then FIG. 9B, and FIG. 9C, then deform to a planar shape close to a circle in the order from FIG. 9C, then FIG. 9D, and FIG. 9E, and swell in a central position of the bonding position at the time of application as is the case with FIGS. 8A to 8C.

Figure 10A:
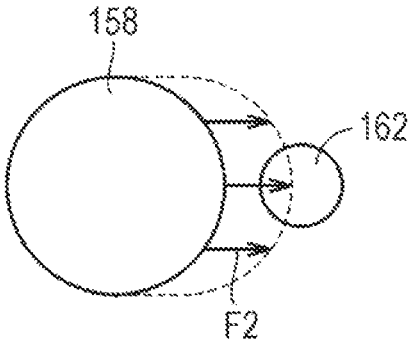
FIGS. 10A to 10C are views schematically illustrating a relationship between a central position in a sub-scanning direction of an application position of an adhesive and an amount by which a thin film portion of the adhesive enters between the scanning optical member and the positioner.
Figure 10B:
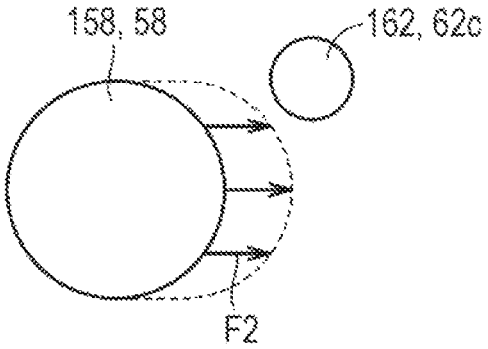
Figure 10C:
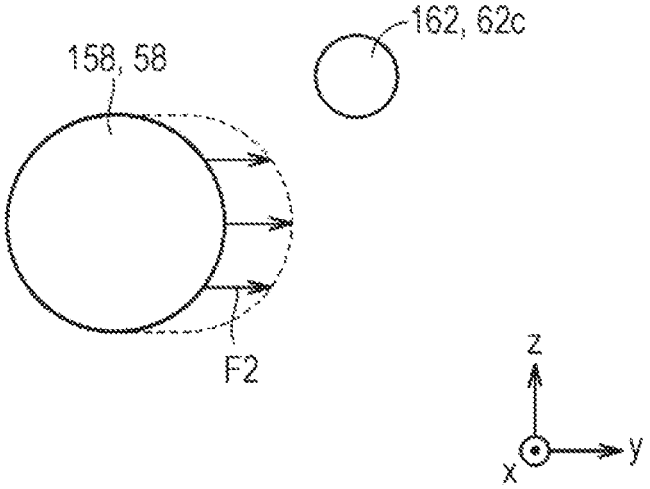

FIGS. 10A to 10C are views schematically illustrating a relationship between a central position in the sub-scanning direction of an application position of the adhesive and an amount by which the thin film portion of the adhesive enters between the scanning optical member and the positioner.

With reference to FIGS. 10A to 10C, arrow F2 indicates a moving direction of the adhesive due to the tensile force caused by the difference in the thermal expansion amount between the scanning optical member and the casing.

In a case where the central position in the sub-scanning direction of the application position of the adhesive 158 and the central position of the positioner 162 in the optical axis direction are close to each other in the sub-scanning direction (in a case of FIG. 10A), an overlapping amount between a position after the movement of the adhesive 158 by the tensile force and the positioner 162 in the optical axis direction becomes large. Therefore, the amount by which the thin film portion of the adhesive 158 enters between the scanning optical member and the positioner 162 increases.

On the other hand, in a case where the central position in the sub-scanning direction of the application position of the adhesive 158 and the central position of the positioner 162 in the optical axis direction are apart from each other in the sub-scanning direction (in a case of FIG. 10B), the overlapping amount between the position after the movement of the adhesive 158 by the tensile force and the positioner 162 in the optical axis direction becomes small Therefore, the amount by which the thin film portion of the adhesive 158 enters between the scanning optical member and the positioner 162 decreases.

Especially, in a case where the central position in the sub-scanning direction of the application position of the adhesive 158 and the central position of the positioner 162 in the optical axis direction are significantly apart from each other in the sub-scanning direction (in a case of FIG. 10C), the overlap between the position after the movement of the adhesive 158 by the tensile force and the positioner 162 in the optical axis direction completely disappears. Therefore, the thin film portion of the adhesive 158 does not enter between the scanning optical member and the positioner 162.

With reference to FIG. 5, on the negative side of the y axis (side on which the two optical axis direction positioners 62*a* and 62*b* are provided) with respect to the central position CL, the central position CP1 in the sub-scanning direction of the positioner 62*a* and the central position CP2 in the sub-scanning direction of the positioner 62*b* tend to separate from the central position CP11 in the sub-scanning direction of the bonding position 51*a* and the central position CP12 in the sub-scanning direction of the bonding position 51*b*. As a result, the adhesive 58 applied to the bonding position 51*a* or 51*b* exhibits a behavior in FIG. 10B or FIG. 10C by the tensile force, and the amount by which this enters between the scanning optical member 50 and the positioner 62*c* decreases. As a result, it is possible to suppress a change in the position in the optical axis direction of the scanning optical member 150 on the negative side of the y axis with respect to the central position CL, and suppress deterioration in optical performance of the optical writing device 2.

[Variation]

Figure 11:
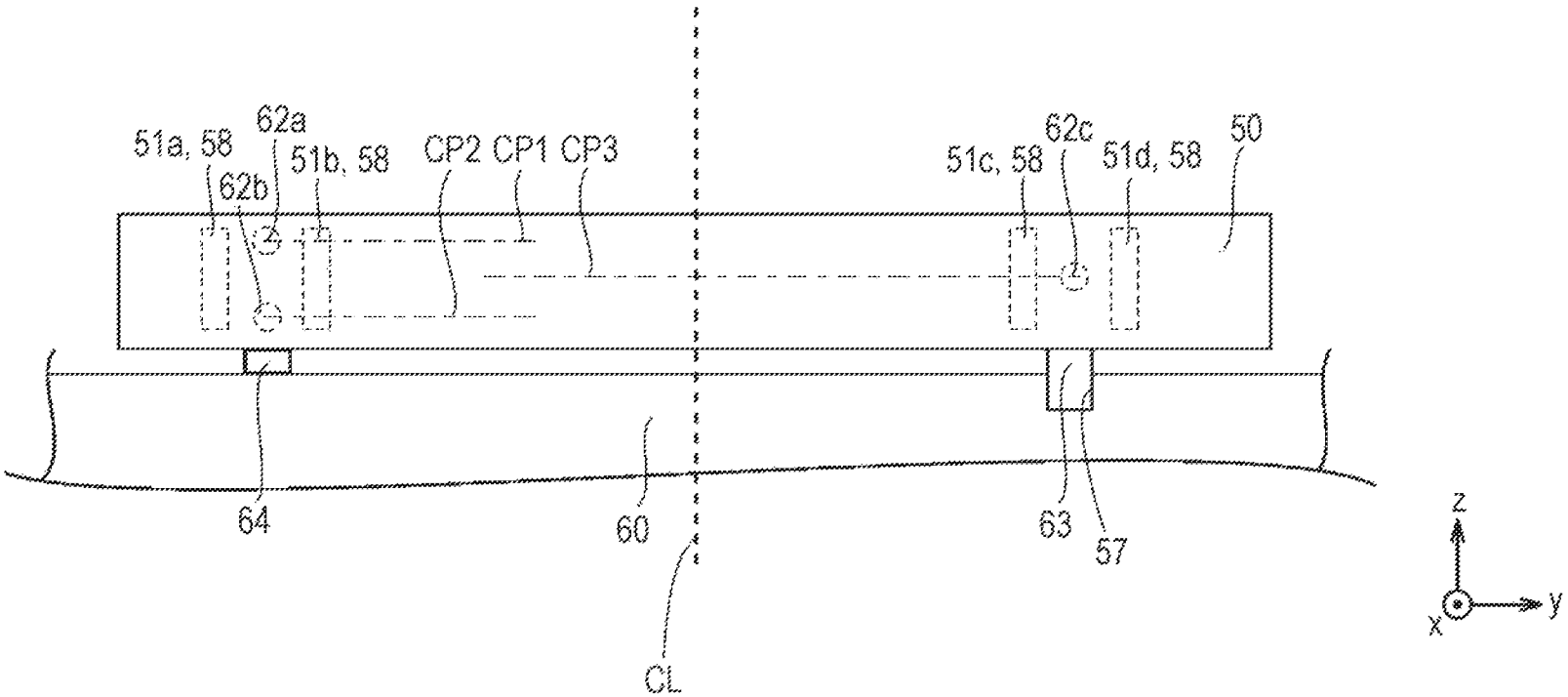
FIG. 11 is a view illustrating a configuration of a scanning optical member in a first variation of an embodiment of the present invention, illustrating the configuration of the scanning optical member as seen from a positive side of an x axis.

FIG. 11 is a view illustrating a configuration of a scanning optical member 50 in a first variation of an embodiment of the present invention, illustrating the configuration of the scanning optical member 50 as seen from a positive side of an x axis.

With reference to FIG. 11, in the first variation, a positioner 63 for defining a position in a main-scanning direction of the scanning optical member 50 includes a convex formed on the scanning optical member 50, the convex engaging with a concave 57 provided on a casing 60.

Figure 12:
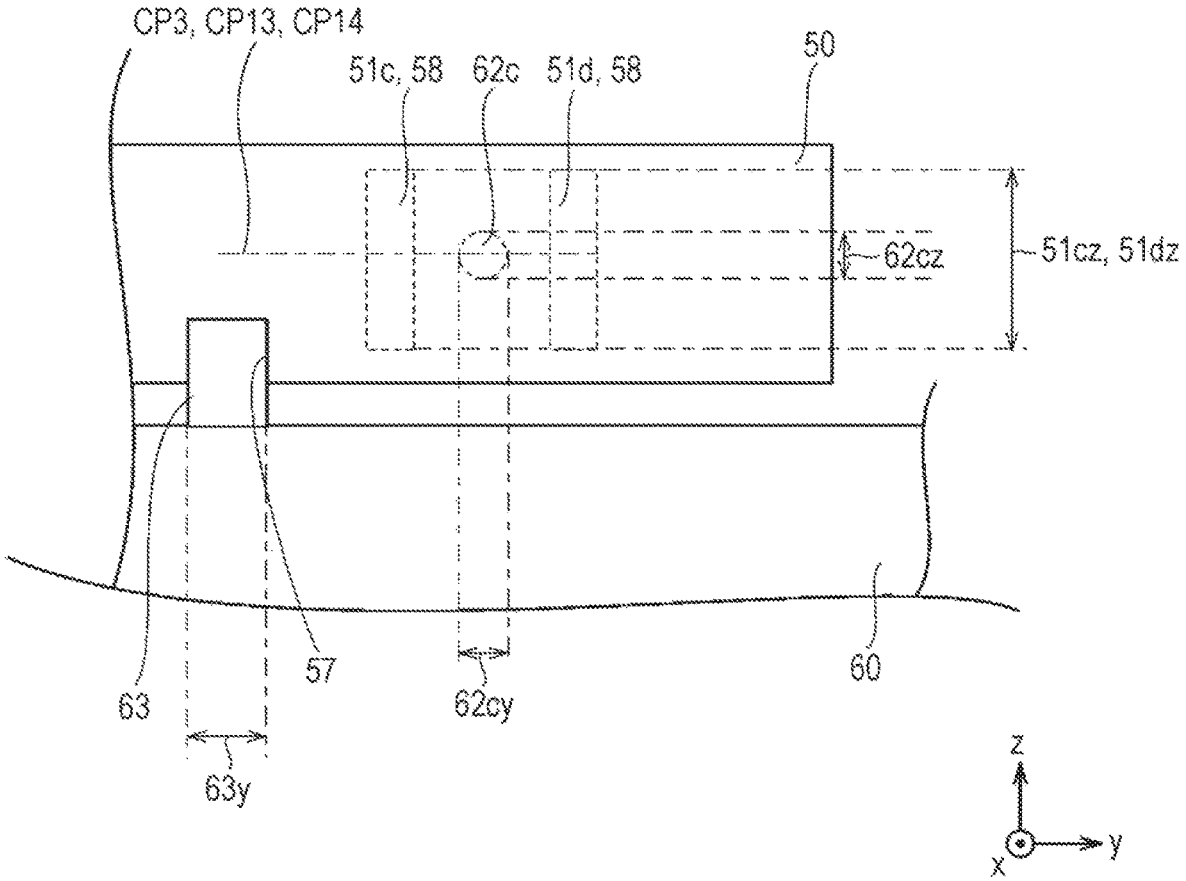
FIG. 12 is a view illustrating a layout in the vicinity of a positioner of a scanning optical member according to a second variation of an embodiment of the present invention.

FIG. 12 is a view illustrating a layout in the vicinity of a positioner 62*c* of a scanning optical member 50 according to a second variation of an embodiment of the present invention.

With reference to FIG. 12, in the second variation, a position 63*y* in a main-scanning direction of a positioner 63 for defining a position in the main-scanning direction of the scanning optical member 50 is closer to a central position CL (left side in FIG. 12) of the scanning optical member 50 in the main-scanning direction than a position 62*cy* in the main-scanning direction of the positioner 62*c*. In this case, a tensile force applied to an adhesive 58 at bonding positions 51*c* and 51*d* located in the vicinity of the positioner 63 is not zero, but it is possible to reduce the tensile force applied to an adhesive 58 applied to bonding positions 51*a* and 51*b* on a negative side of a y axis with respect to the central position CL.

Figure 13:
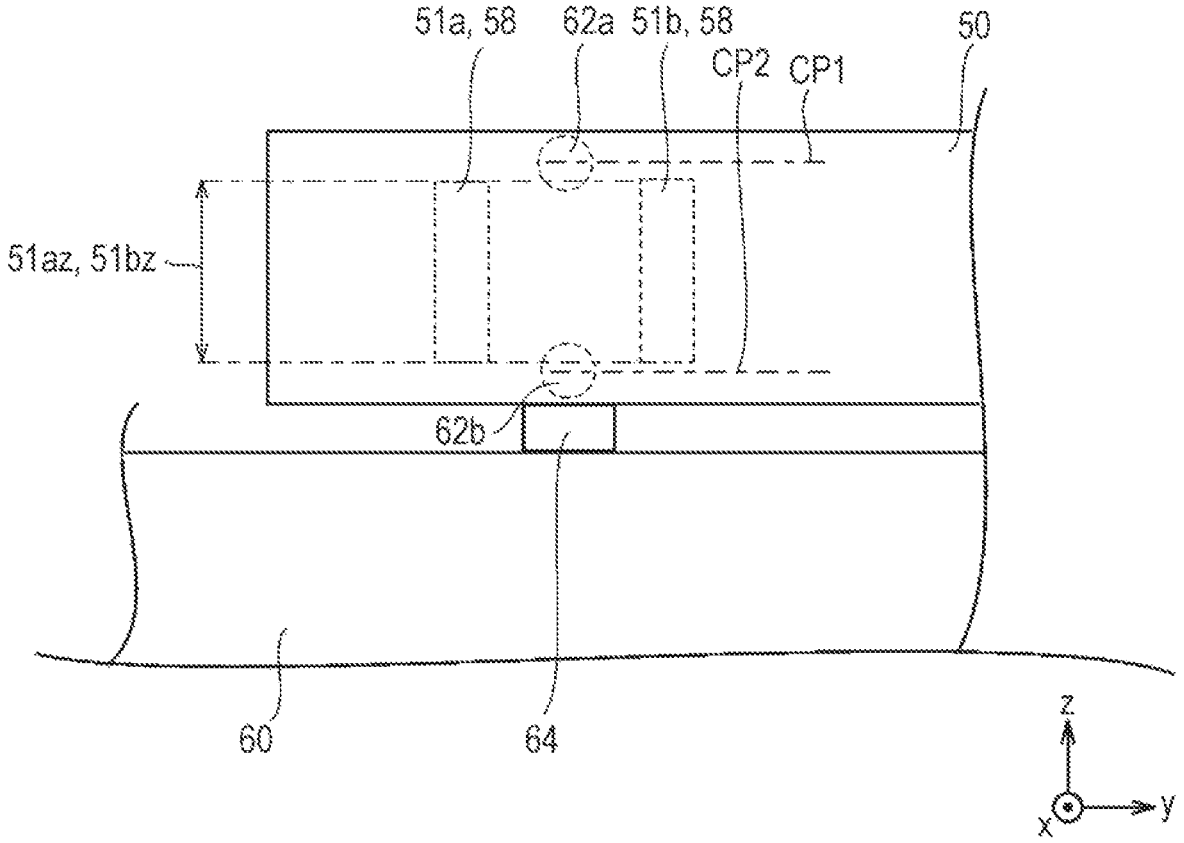
FIG. 13 is a view illustrating a layout in the vicinity of positioners of a scanning optical member according to a third variation of an embodiment of the present invention.

FIG. 13 is a view illustrating a layout in the vicinity of positioners 62*a* and 62*b* of a scanning optical member 50 according to a third variation of an embodiment of the present invention.

With reference to FIG. 13, in the third variation, each of a central position CP1 in a sub-scanning direction of the positioner 62*a* and a central position CP2 in the sub-scanning direction of the positioner 62*b* does not overlap with a position 51*az* in the sub-scanning direction of a bonding position 51*a* and a position 51*bz* in the sub-scanning direction of a bonding position 51*b*. A central position CP1 in the sub-scanning direction of a positioner 62*a* is located in a position on a side farther from a casing 60 than the position 51*az* in the sub-scanning direction of the bonding position 51*a* and the position 51*bz* in the sub-scanning direction of the bonding position 51*b* (positive side of a z axis). The central position CP2 in the sub-scanning direction of the positioner 62*b* is located in a position on a side closer to the casing 60 than the position 51*az* in the sub-scanning direction of the bonding position 51*a* and the position 51*bz* in the sub-scanning direction of the bonding position 51*b* (negative side of the z axis).

According to the third variation, an overlapping amount of a position after movement by a tensile force of an adhesive 58 at the bonding positions 51*a* and 51*b* and the positioners 62*a* and 62*b* in an optical axis direction becomes small, and an amount by which a thin film portion of the adhesive 58 enters between the scanning optical member 50 and the positioners 62*a* and 62*b* may be further reduced.

Figure 14:
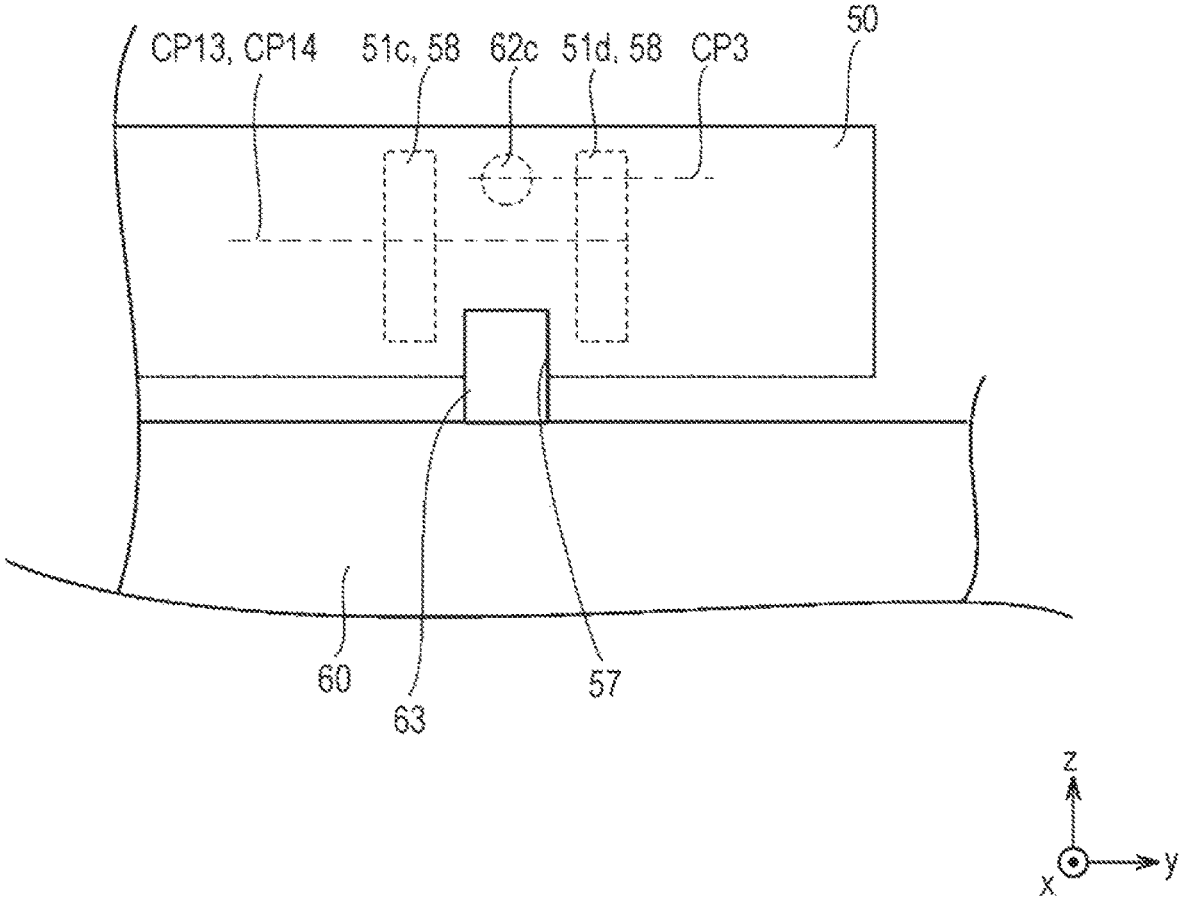
FIG. 14 is a view illustrating a layout in the vicinity of a positioner of a scanning optical member according to a fourth variation of an embodiment of the present invention.
Figure 15:
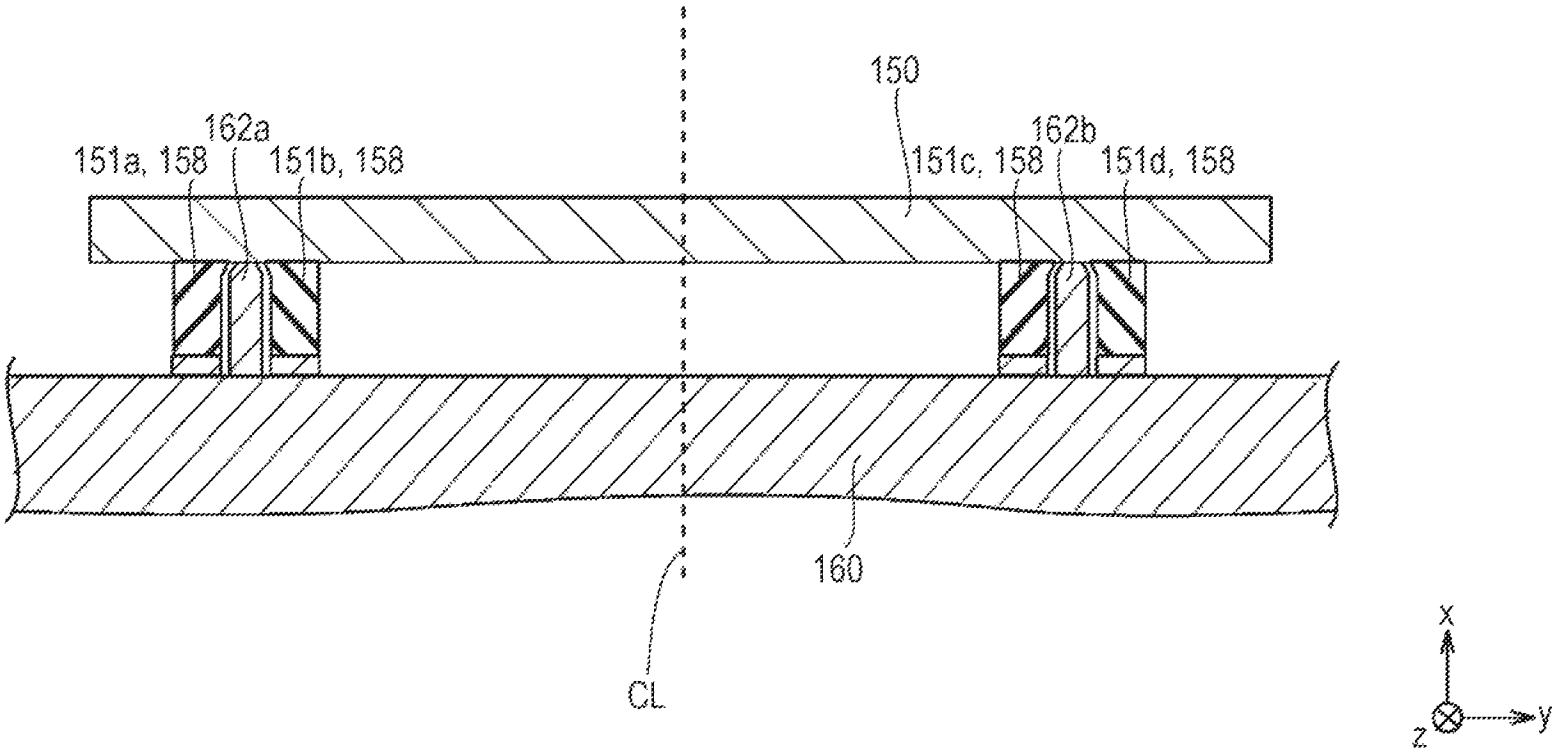
FIG. 15 is a cross-sectional view schematically illustrating a configuration of a bonding portion between a scanning optical member and a casing in a conventional optical writing device.
Figure 16:
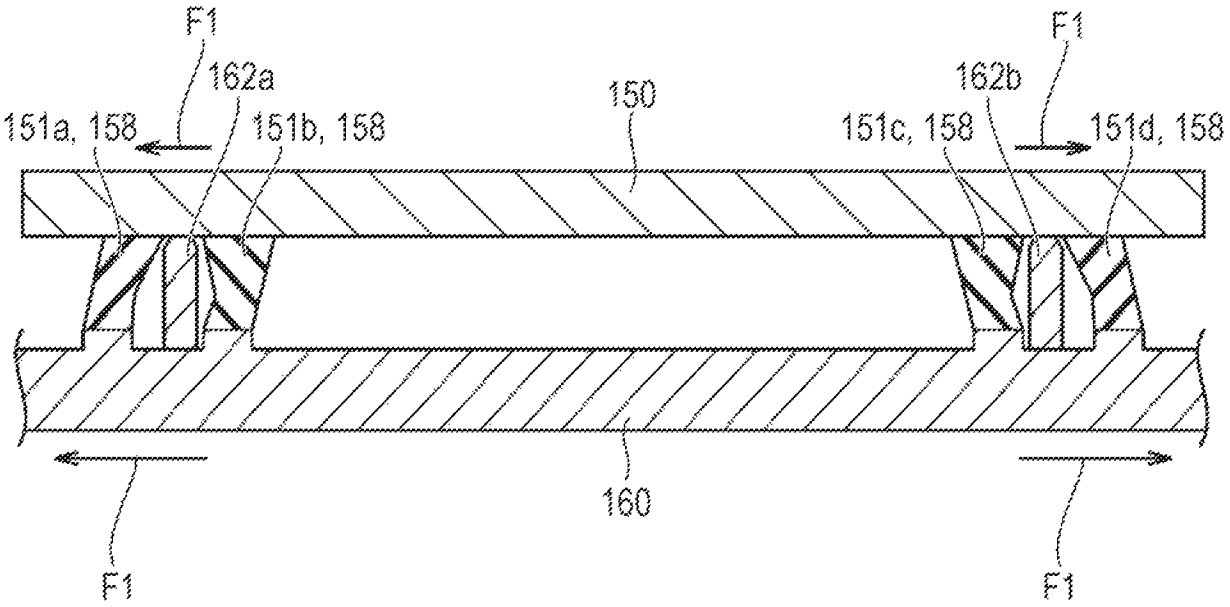
FIG. 16 is a view schematically illustrating a tensile force generated due to thermal expansion of the scanning optical member and the casing in the conventional optical writing device.

FIG. 14 is a view illustrating a layout in the vicinity of a positioner 62*c* of a scanning optical member 50 according to a fourth variation of an embodiment of the present invention.

With reference to FIG. 14, in the fourth variation, a central position CP3 in a sub-scanning direction of the positioner 62*c* is located in a position on a side farther from a casing 60 than a central position CP13 in the sub-scanning direction of a bonding position 51*a* and a central position CP14 in the sub-scanning direction of a bonding position 51*b* (positive side of a z axis).

According to the fourth variation, an overlapping amount between a position after movement due to a tensile force of an adhesive 58 at bonding positions 51*c* and 51*d* and a positioner 62*c* in an optical axis direction becomes small, and an amount by which a thin film portion of the adhesive 58 enter between the scanning optical member 50 and the positioner 62*c* may be further reduced.

[Others]

The above-described embodiment and variations may be combined as appropriate.

Although embodiments of the present invention have been described and illustrated in detail, the disclosed embodiments are made for purposes of illustration and example only and not limitation. The scope of the present invention should be interpreted by terms of the appended claims, and all modifications within the scope are included.

What is claimed is:

1. An optical writing device comprising:

a light source;

a deflector that deflects light emitted from the light source to scan;

an imager that images the light deflected by the deflector on a surface to be scanned; and a casing that holds the imager;

wherein the imager includes a scanning optical member having a power in a main-scanning direction, the scanning optical member having a linear expansion coefficient different from a linear expansion coefficient of the casing, the casing includes an optical axis direction positioner that protrudes in an optical axis direction of the scanning optical member and is in contact with the scanning optical member in the optical axis direction, the optical axis direction positioner includes two one side positioners located on one side with respect to a central position of the scanning optical member in the main-scanning direction, and one other side positioner located on the other side with respect to the central position of the scanning optical member in the main-scanning direction, a central position in a sub-scanning direction of the one other side positioner is located between central positions in the sub-scanning direction of the two one side positioners, the scanning optical member is bonded to the casing at a bonding position, and a position in the sub-scanning direction of the bonding position and a position in the sub-scanning direction of the optical axis direction positioner overlap with each other, a main-scanning direction positioner that defines a position in the main-scanning direction of the scanning optical member with respect to the casing is further provided, and the main-scanning direction positioner is located on the other side with respect to the central position of the scanning optical member in the main-scanning direction.

2. The optical writing device according to claim 1, wherein the bonding position includes two one side bonding positions that interpose the two one side positioners in the main-scanning direction on the one side with respect to the central position of the scanning optical member in the main-scanning direction, and two other side bonding positions that interpose the one other side positioner in the main-scanning direction on the other side with respect to the central position of the scanning optical member in the main-scanning direction.

3. The optical writing device according to claim 2, wherein the central positions in the sub-scanning direction of the two one side positioners are different from central positions in the sub-scanning direction of the one side bonding positions.

4. The optical writing device according to claim 3, wherein the central positions in the sub-scanning direction of the two one side positioners do not overlap with positions in the sub-scanning direction of the one side bonding positions.

5. The optical writing device according to claim 2, wherein the central position in the sub-scanning direction of the one other side positioner is located on a side farther from the casing than central positions in the sub-scanning direction of the other side bonding positions.

6. The optical writing device according to claim 1, wherein a position in the main-scanning direction of the main-scanning direction positioner and a position in the main-scanning direction of the one other side positioner overlap with each other.

7. The optical writing device according to claim 1, wherein a position in the main-scanning direction of the main-scanning direction positioner is closer to the central position of the scanning optical member in the main-scanning direction than a position in the main-scanning direction of the one other side positioner.

8. The optical writing device according to claim 1, wherein the main-scanning direction positioner includes a convex formed on the casing, the convex that engages with a concave provided on the scanning optical member.

9. The optical writing device according to claim 1, wherein the main-scanning direction positioner includes a convex formed on the scanning optical member, the convex that engages with a concave provided on the casing.

10. The optical writing device according to claim 1, not comprising:

a biasing member that biases the scanning optical member toward the optical axis direction positioner.

11. An image forming device comprising:

the optical writing device according to claim 1;

an image former that forms a toner image obtained by developing an electrostatic latent image formed by the optical writing device on paper; and a fixer that fixes the toner image formed by the image former on the paper.

* * * * *